US007541900B2

(12) United States Patent
Portier

(10) Patent No.: US 7,541,900 B2
(45) Date of Patent: Jun. 2, 2009

(54) MODULE FOR ELECTRICAL CONNECTION BETWEEN A FIRST AND A SECOND CONTACTOR AND CORRESPONDING REVERSER ASSEMBLY

(75) Inventor: Alain Portier, Lyons (FR)

(73) Assignee: ABB France, Rueil-Malmaison (FR)

( * ) Notice: Subject to any disclaimer, the term of this patent is extended or adjusted under 35 U.S.C. 154(b) by 24 days.

(21) Appl. No.: 11/905,083

(22) Filed: Sep. 27, 2007

(65) Prior Publication Data

US 2008/0100405 A1 May 1, 2008

(30) Foreign Application Priority Data

Oct. 27, 2006 (FR) ..... 06 09462

(51) Int. Cl.
*H01H 9/00* (2006.01)

(52) U.S. Cl. ..... 335/159; 335/132; 335/160; 200/50.32

(58) Field of Classification Search ..... 335/132, 335/159–163; 200/43.16, 50.32–50.4
See application file for complete search history.

(56) References Cited

U.S. PATENT DOCUMENTS 4,544,814 A * 10/1985 Butterworth et al. ..... 200/50.33
4,717,899 A * 1/1988 Drexler et al. ..... 335/131
4,774,484 A * 9/1988 Lehman et al. ..... 335/197
4,924,041 A 5/1990 Yee
5,189,385 A * 2/1993 Gnahn ..... 335/132
5,216,398 A * 6/1993 Hirota ..... 335/160
5,289,146 A * 2/1994 Plumeret et al. ..... 335/160
5,369,229 A * 11/1994 Agut Sanz ..... 200/50.32
6,140,896 A * 10/2000 Heckenkamp ..... 335/159
2006/0070861 A1 4/2006 Bogdon et al.

* cited by examiner

*Primary Examiner*—Ramon M Barrera
(74) *Attorney, Agent, or Firm*—Oliff & Berridge, PLC

(57) ABSTRACT

The invention relates to a module for electrical locking between a first and a second contactor, comprising a first and a second normally closed auxiliary contact for respectively cooperating with a slide of the first and the second contactor, a first and a second connecting member of the module for cooperating respectively with a connecting member of the first and the second contactor, a first connection terminal being connected in series with the first normally closed auxiliary contact and with the second connecting member of the module, a second connection terminal being connected in series with the second normally closed auxiliary contact and with the first connecting member of the module, and the first and second connecting members of the module being positioned on a face of the body, at a first and a second part of the module respectively, respectively intended to be arranged on the front face of the first and the second contactor.

5 Claims, 5 Drawing Sheets

MODULE FOR ELECTRICAL CONNECTION BETWEEN A FIRST AND A SECOND CONTACTOR AND CORRESPONDING REVERSER ASSEMBLY

BACKGROUND OF THE INVENTION

The invention relates to an electrical connection module for electrical locking between a first and a second contactor as well as a corresponding reverser assembly.

DESCRIPTION OF THE PRIOR ART

Achievement of mechanical locking is known for example from document U.S. Pat. No. 4,924,041.

Conventional contactor electrical locks are achieved through manual wiring by an operator. During this operation which can take a long time to carry out, a wiring error may occur.

SUMMARY OF THE INVENTION

The aim of the present invention is to overcome these disadvantages by proposing a module for providing electrical locking of a first and a second contactor as well as a corresponding assembly which can be achieved easily and quickly.

To this effect, the invention relates to a module for electrical connection between a first and a second contactor, which includes a body comprising:

- a first and a second normally closed auxiliary contact for respectively cooperating with a slide of the first and of the second contactor;
- a first and a second connection terminal for cooperating with an external circuit in order to feed each of the two coils; and
- a first and a second connecting member of the module for cooperating respectively with a connecting member of the first and the second contactor,
- the first connection terminal being connected in series with the first normally closed auxiliary contact and with the second connecting member of the module, the second connection terminal being connected in series with the second normally closed auxiliary contact and with the first connecting member of the module,
- the first and second connecting members of the module being positioned on a face of the body, at a first and a second part of the module respectively, and
- the first and the second parts of the module being respectively intended to be arranged on the front face of the first and the second contactor.

The module according to the invention allows the connection of a first and a second contactor, while avoiding manual wiring.

When the first contactor is in a closed state, i.e. when the coil of the first contactor is fed, the second contactor is forced into an open state. This module thus allows, in a simple manner, for simultaneous closure of the first and second contactors to be prevented, and therefore for electrical locking between these contactors to be achieved.

The invention furthermore relates to an assembly including a first and a second contactor, each contactor comprising:

- an insulating body delimited by a front face, a rear face, which is opposite the front face, and which includes means for fixing on a support;
- a control coil accommodated in the insulating body;
- means for connecting the coil for the purpose of feeding it; and

- a slide, in which the coil connection means include a connecting member arranged close to the front face of the body, facing an opening therein, the first and the second contactors being connected by a module according to the invention.

According to one feature of the invention, a connecting member of a contactor and the corresponding connecting member of the module respectively include an elastic portion, notably made up of a buckle, and a rigid portion, notably made up of a rigid lug, or vice versa.

Preferably, the module includes first and second fixing means, which are arranged at the first and the second part of the module respectively and which cooperate with fixing means of the first and the second contactor respectively.

BRIEF DESCRIPTION OF THE DRAWING

In any case, the invention will be properly understood from the following description with reference to the appended schematic drawing which illustrates an embodiment of this module and of this assembly, by way of non-limiting example.

DESCRIPTION OF THE PREFERRED EMBODIMENTS

Figure 1:
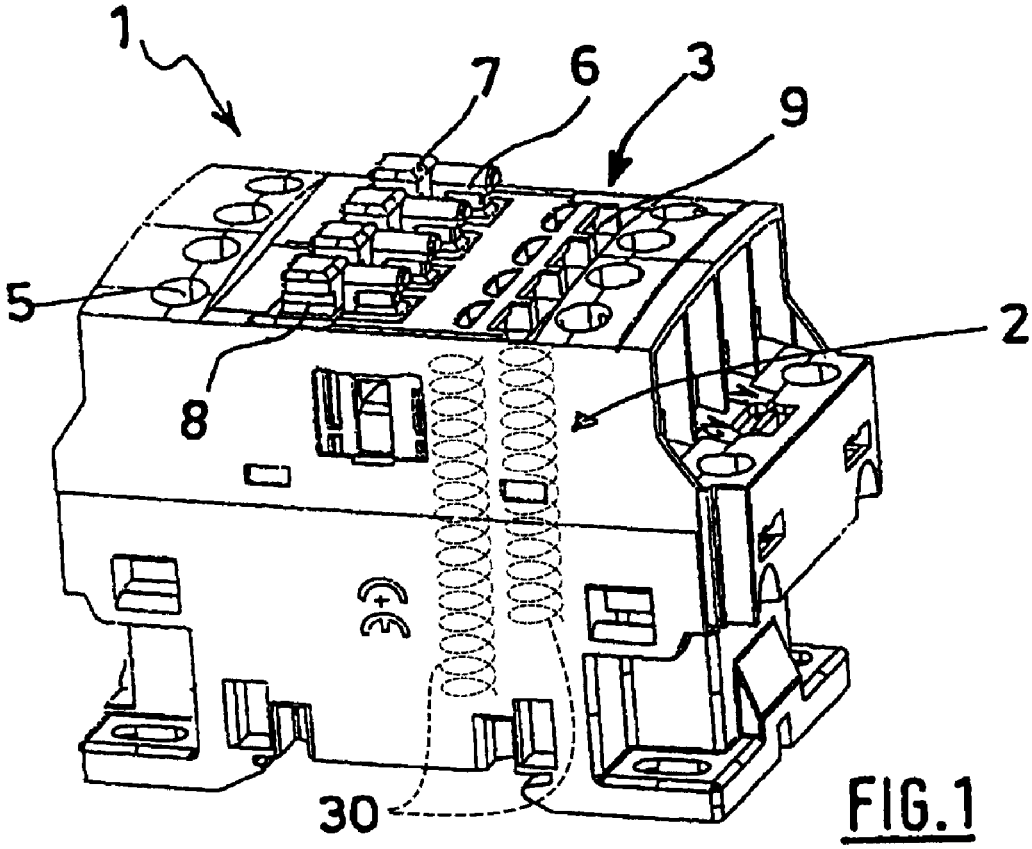
FIGS. 1 and 2 are a perspective view, from above and below respectively, of a conventional contactor.
Figure 2:
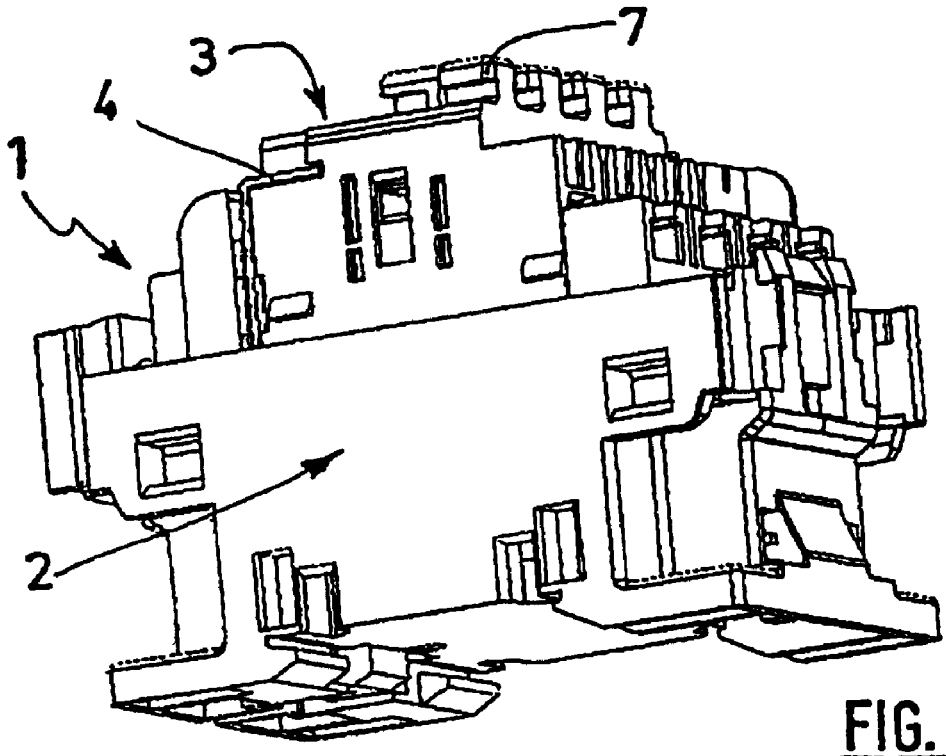

FIGS. 1 and 2 describe a contactor comprising:

- an insulating body 2 delimited by a front face 3, a rear face, which is opposite the front face, and which includes means for fixing on a support rail, which are not shown;
- control coils 30 accommodated in the insulating body; and
- a connecting member 4 arranged close to the front face of the body, facing an opening therein and allowing connection of the control coils 30.

The connecting member of the contactors includes, for example, a rigid portion, notably made up of a rigid lug.

The contactor further comprises power connection terminals 5, which are also known to those skilled in the art, as well as at least one slide 6, which is accessible at the front face 3 of the body 2.

The body 2 is furthermore equipped with several fingers 7 projecting outwards from the front face 3, on the side faces of which locking grooves 8 are arranged.

Finally, the body 2 comprises, at its upper part, fixing recesses 9 which are arranged in the direction of the grooves 8 and which open outwards.

Figure 3:
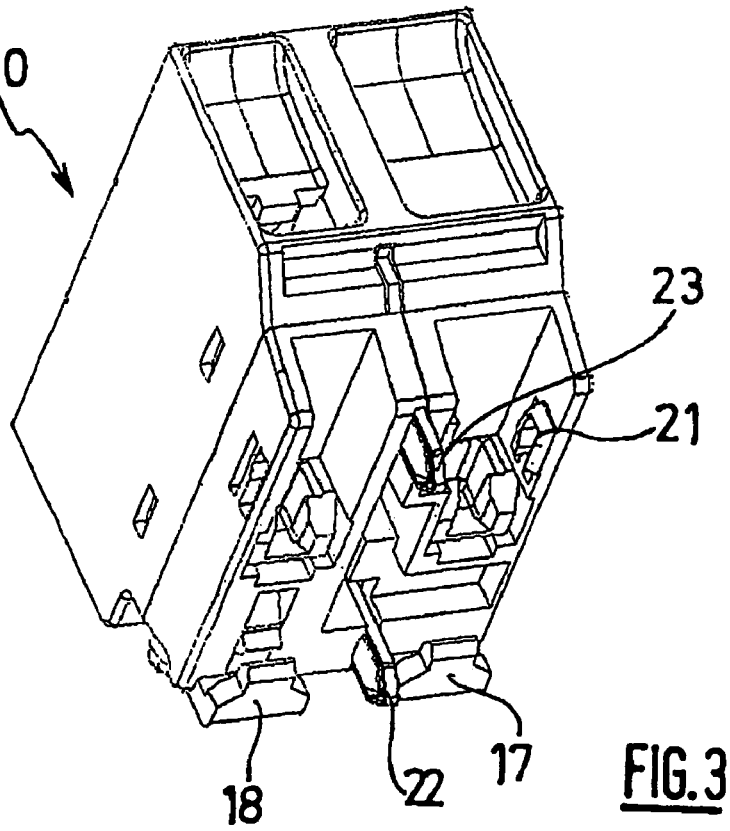
FIG. 3 is a perspective view, from below, of a module according to the invention.
Figure 4:
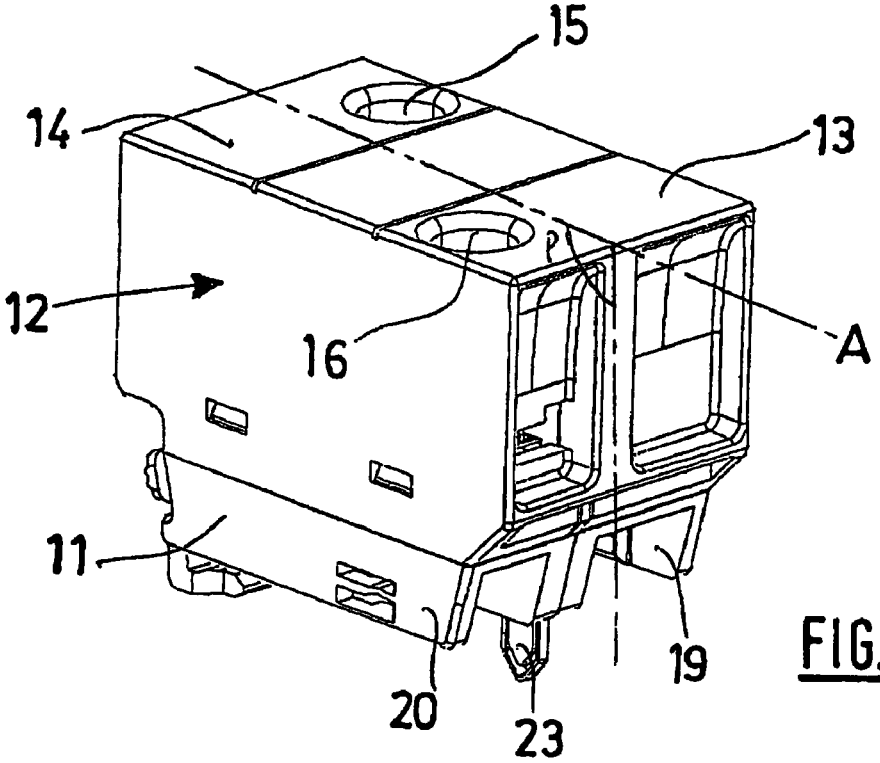
FIG. 4 is a perspective view, from above.

FIGS. 3 and 4 describe a detachable module 10, intended to be fixed and cooperate with two adjacent contactors 1', 1".

The module 10, which has a substantially parallelepipedal and elongate shape, includes a body 11 on which a cover 12 is fixed by being snapped thereonto.

The module is divided into two side parts 13, 14 in relation to the mid-plane P. As will be seen in the rest of the description, each side part 13, 14 comprises the same functional members.

Thus, each side part 13, 14 of the detachable module comprises a connection terminal 15, 16 at the upper part, and a fixing lug 17, 18, at the lower part, protruding downwards, the end of which is curved inwards, parallel to the axis A of the module.

Likewise, each side part 13, 14 comprises, at the lower part, a U-shaped region 19, 20 extending along the axis A of the module.

The internal flanges of each of the two U-shaped regions 19, 20 are arranged in an adjacent manner, the external flanges each comprising an elastic, locking tongue 21 protruding towards the inside of the corresponding U-section.

The body 11 further comprises two connecting members 22, 23 protruding downwards, each connecting member 22, 23 being arranged roughly at an end of the body 11. As before, the two connecting members 22, 23 are arranged on either side of the body 11 in relation to the mid-plane P thereof, more particularly at each internal flange of the U-sections 19, 20.

Each connecting member 22, 23 forms an elastic buckle for cooperating with the connecting member 4 of the corresponding contactor 1.

Figure 5:
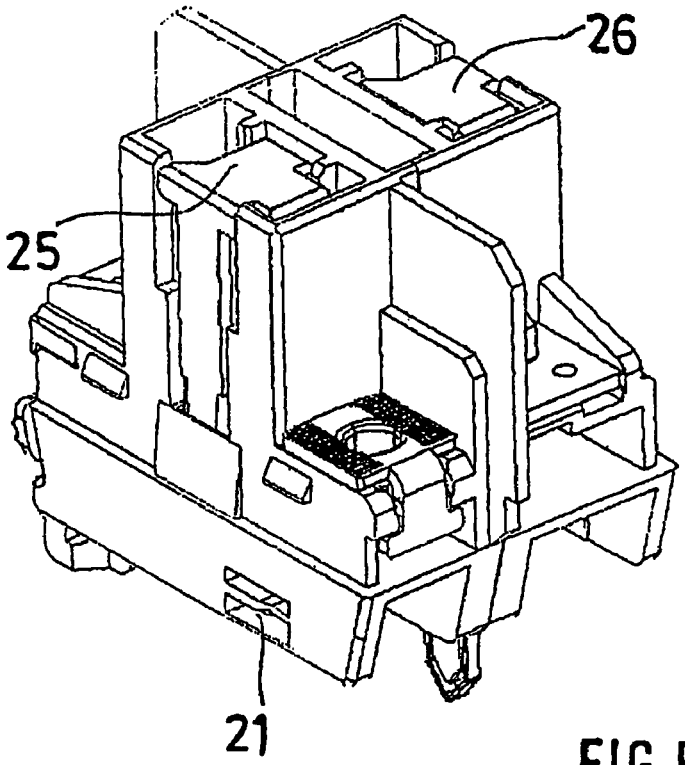
FIGS. 5 and 6 are perspective views of certain components of this module.

FIG. 5 shows the detachable module 10 in perspective, from above, the cover 12 having been removed for the purpose of visibility.

As can been seen from this figure, the body 11 comprises, at each side part 13, 14, an open housing 24 in which a moveable auxiliary contact 25, 26 is arranged.

Figure 6:
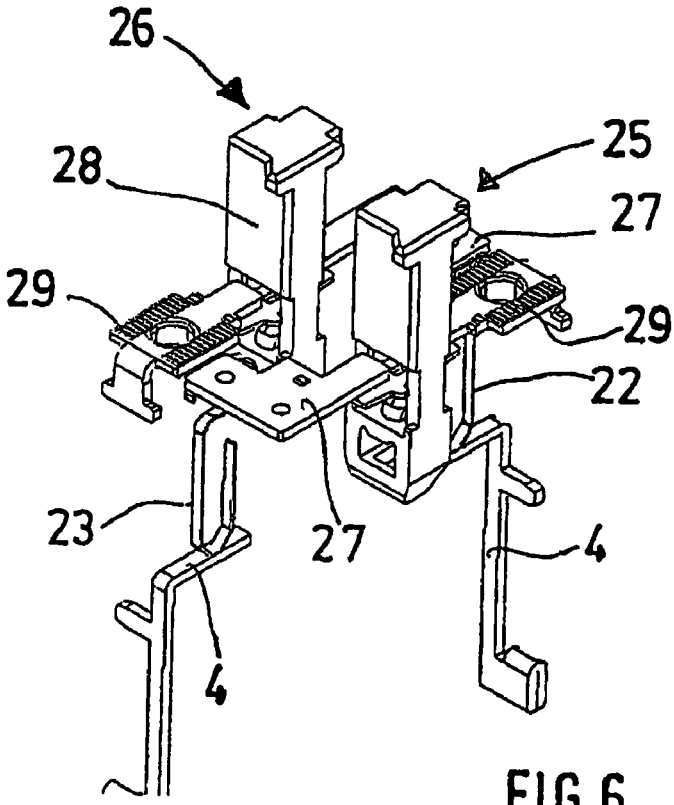

An auxiliary contact 25, 26 is illustrated more particularly in FIG. 6. This includes a moveable pusher 28 with moveable contacts connected by a conductive bridge, the moveable contacts being intended to cooperate with fixed contacts connected with the corresponding connecting member 22, 23 of the module on the one hand, and with the corresponding connection terminal of the module on the other, via conductive portions 27, 29.

Each auxiliary contact 25, 26 is of the normally closed type. When the auxiliary contact 25, 26 is actuated, i.e. when the pusher 28 is moved downwards, the connecting member 22, 23 and the connection terminal 15, 16 are electrically disconnected. Conversely, when the auxiliary contact 25, 26 is not actuated, i.e. when the pusher 28 is carried upwards, the electrical link between the connection terminal 15, 16 and the connecting member 22, 23 is established.

The movements of the pusher 28 are obtained via the slide of the corresponding contactor, as will be described hereafter.

The detachable module 10 thus comprises a first connection terminal 15, a first auxiliary contact 25 and a first connecting member 22, which are arranged at the first side part 13 of the module 10. The first auxiliary contact 25 and the first connecting member 22 are intended to cooperate with a first contactor 1'.

Likewise, the detachable module 10 comprises a second connection terminal 16, a second auxiliary contact 26 and a second connecting member 23, which are arranged at the second side part 14 of the module 10. The second auxiliary contact 26 and the second connecting member 23 are intended to cooperate with a second contactor 1", which is adjacent to the first contactor 1'.

Figure 7:
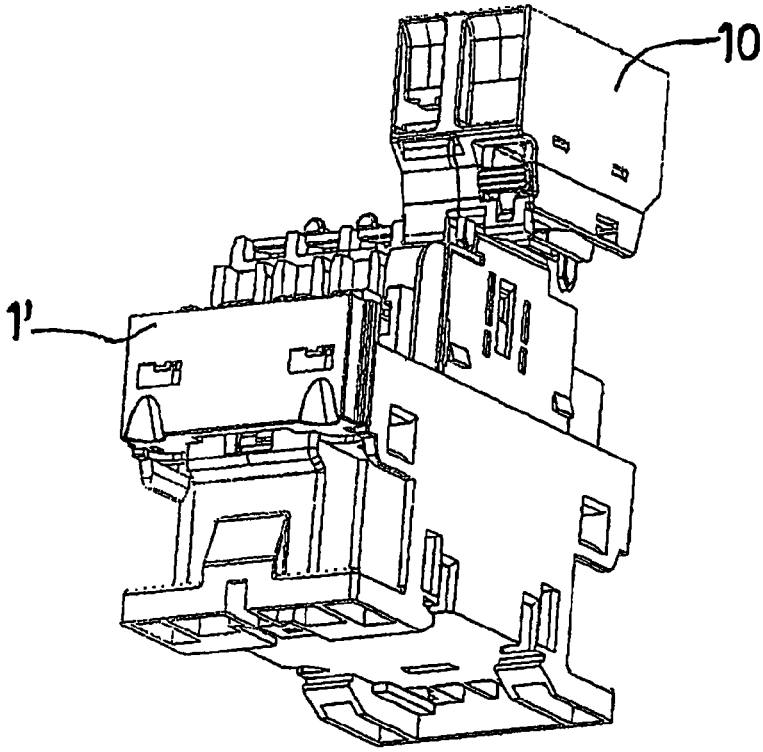
FIGS. 7 and 8 are views showing the assembly of the module on the contactors.
Figure 8:
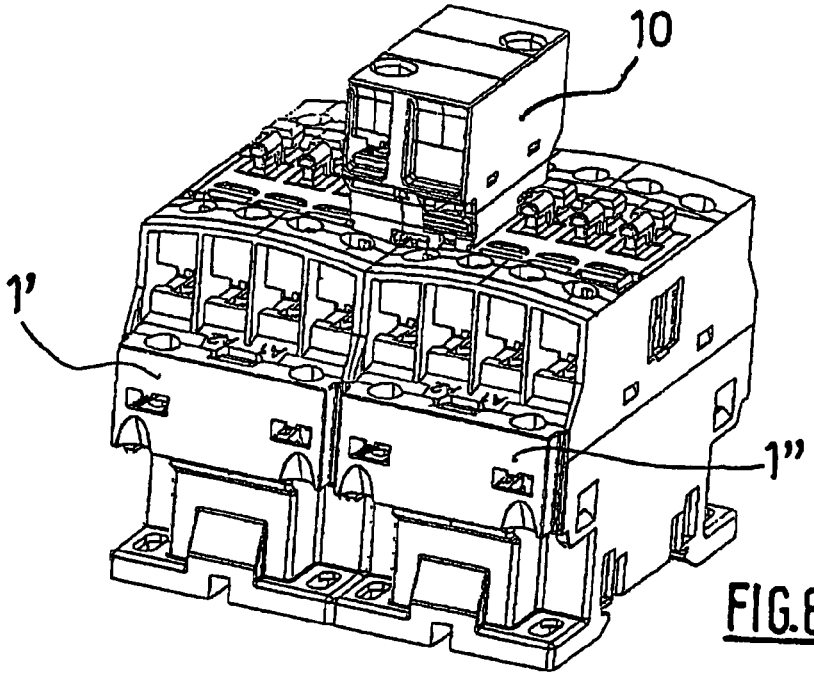

FIGS. 7 and 8 show the module being assembled on the contactors 1' and 1".

Figure 9:
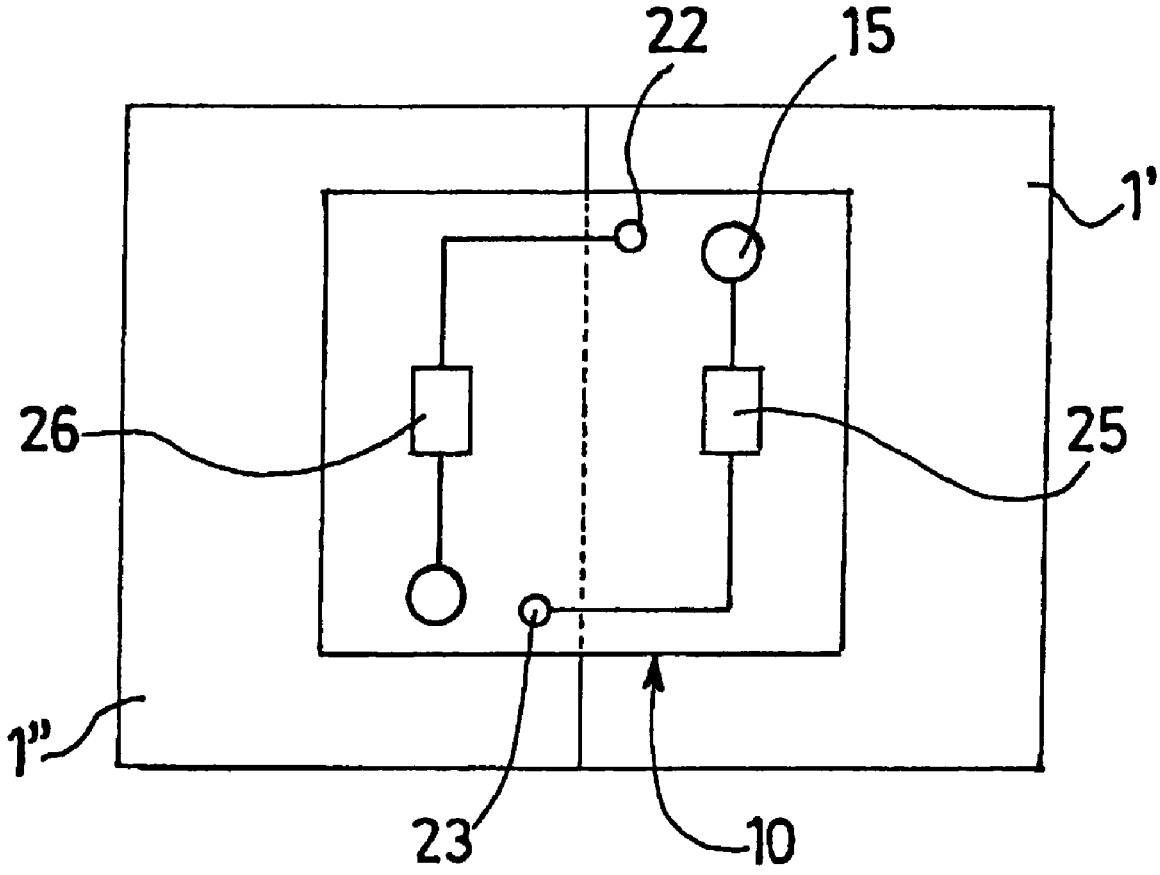
FIG. 9 is a view of the wiring diagram of the assembly according to the invention.

As FIG. 9 schematically illustrates, the first connection terminal 15 is electrically connected to the moveable lug 29 of the first auxiliary contact 25, the fixed lug 27 of the latter being electrically connected to the second connecting member 23 of the detachable module 10.

Likewise, the second connection terminal 16 is electrically connected to the moveable lug 29 of the second auxiliary contact 26, the fixed lug 27 of the latter being electrically connected to the first connecting member 22 of the detachable module 10.

Assembly of the detachable module 10 on the contactors 1', 1" shall be described hereafter, as shall the functioning of the assembly.

The moveable module 10 is positioned at the front face of the contactors 1', 1", the first side part 13 of the module cooperating with the first contactor 1', the second side part 14 cooperating with the second contactor 1".

It is in this manner that the ends of each fixing lug 17, 18 engage in the fixing recess 9 of the corresponding contactor 1', 1", the elastic tongues 21 cooperating with the locking grooves 8 arranged on the contactors 1', 1".

Furthermore, each connecting member 22, 23 of the module 10 cooperates with the connecting member 4 of a contactor. It is in this manner that the first 22 and second 23 connecting members of the module allow for the feeding of the coils of the first 1' and second 1" contactors respectively.

Moreover, the pusher 28 of each auxiliary contact 25, 26 of the module is connected to the slide of the corresponding contactor such that the actuation of the auxiliary contact 25, 26, i.e. the opening thereof during its movement towards the bottom of the pusher 28, is obtained by the actuation of the slide, which itself is actuated by the coil in a known manner.

Thus, the first 25 and second 26 auxiliary contacts are actuated during the feeding of the coils of the first 1' and second 1" contactors respectively.

The external electric circuit is furthermore connected to the module 10 via the first 15 and second 16 connection terminals.

Thus, if the first contactor 1' is closed, the corresponding slide actuates the first auxiliary contact 25 of the module 10. In this case, even if a voltage is applied at the first connection terminal 15, the electrical connection with the coil of the second contactor 1", via the second connecting member 23 and the first auxiliary contact 25, cannot be produced.

Indeed, as has already been pointed out, the auxiliary contact of the normally closed type prevents any electrical connection when it is actuated.

It is in this manner that when the first contactor 1' is closed, the second contactor 1" cannot be closed at the same time.

On the contrary, if the first contactor 1' is open, the application of a voltage at the first connection terminal 16 allows the second contactor 1" to be closed.

Likewise, when the second contactor 1" is closed, the second auxiliary contact 25 of the module 10 is actuated, such that the coil of the first contactor 1' cannot be fed.

This assembly, which is obtained simply and without manual wiring, allows for the simultaneous closure of two contactors 1', 1" to be prevented.

Of course, the invention is not limited only to the embodiments of this assembly which are described above by way of example, but relates on the contrary to all alternatives.

The invention claimed is:

1. A module for electrical locking between a first and a second contactor, which includes a body comprising:

a first and a second normally closed auxiliary contact for respectively cooperating with a slide of the first and the second contactor;

a first and a second connection terminal for cooperating with an external circuit in order to feed each of the two coils of the contactors; and a first and a second connecting member of the module for cooperating respectively with a connecting member of the first and the second contactor, the first connection terminal being connected in series with the first normally closed auxiliary contact and with the second connecting member of the module, the second connection terminal being connected in series with the second normally closed auxiliary contact and with the first connecting member of the module, the first and second connecting members of the module being positioned on a face of the body, at a first and a second part of the module respectively, and the first and the second parts of the module being respectively intended to be arranged on the front face of the first and the second contactor.

2. A reverser assembly including a first and a second contactor, each contactor comprising:

an insulating body delimited by a front face, a rear face, which is opposite the front face, and which includes means for fixing on a support;

a control coil accommodated in the insulating body;

means for connecting the coil for the purpose of feeding it; and a slide, wherein the coil connection means include a connecting member arranged close to the front face of the body, facing an opening therein, the first and the second contactors being connected by a module as claimed in claim 1.

3. The assembly as claimed in claim 2, wherein a connecting member of a contactor and the corresponding connecting member of the module respectively include an elastic portion, notably made up of a buckle, and a rigid portion, notably made up of a rigid lug, or vice versa.

4. The assembly as claimed in claim 2, wherein the module includes first and second fixing means, which are arranged at the first and the second part of the module respectively and which cooperate with fixing means of the first and the second contactor respectively.

5. The assembly as claimed in claim 3, wherein the module includes first and second fixing means, which are arranged at the first and the second part of the module respectively and which cooperate with fixing means of the first and the second contactor respectively.

* * * * *